United States Patent [19]

Moreau

[11] 4,343,169

[45] Aug. 10, 1982

[54] PROCESS FOR CONTINUOUS HYDROSTATIC EXTRUSION OF METALS THEREFOR

[75] Inventor: Marc Moreau, Asnieres, France

[73] Assignee: Trefimetaux, Clichy, France

[21] Appl. No.: 81,037

[22] Filed: Oct. 1, 1979

[30] Foreign Application Priority Data

Oct. 12, 1978 [FR] France ..... 78 29852

[51] Int. Cl.[3] ..... B21C 23/32; B21C 29/00

[52] U.S. Cl. ..... 72/45; 72/60; 72/262

[58] Field of Search ..... 72/60, 262, 270, 43, 72/45, 44

[56] References Cited

U.S. PATENT DOCUMENTS

| | | | |
|---|---|---|---|
| 3,731,509 | 5/1973 | Fuchs | 72/60 |
| 3,738,138 | 6/1973 | Fuchs | 72/60 |
| 3,926,023 | 12/1975 | Hayashi et al. | 72/60 |
| 3,967,485 | 7/1976 | Oguchi et al. | 72/60 |
| 4,041,745 | 8/1977 | Moreau | 72/262 |
| 4,111,023 | 9/1978 | Moreau | 72/60 |
| 4,163,377 | 8/1979 | Moreau | 72/262 |

*Primary Examiner*—Lowell A. Larson

*Attorney, Agent, or Firm*—Dennison, Meserole, Pollack & Scheiner

[57] ABSTRACT

An improved continuous hydrostatic extrusion process and apparatus for metals is disclosed. In order to reduce the leaks of viscous fluid through the clearances between the rotor and the stator, which clearances are necessary for operation of the apparatus, the drive fluid used in the groove of the rotor to cause forward movement of the blank is of a higher viscosity than the fluid in the isostatic chamber in which extrusion pressure is present. The pumping power is acccordingly greatly reduced and it is possible to avoid the use of expensive and delicate pressure multiplying means.

8 Claims, 7 Drawing Figures

PROCESS FOR CONTINUOUS HYDROSTATIC EXTRUSION OF METALS THEREFOR

The present invention concerns improvements in apparatus and processes for continuous hydrostatic extrusion.

It is known, since the work carried out by P. W. Bridgman that the ductility of many metals and alloys increases when an increasing pressure is applied thereto, and that they may be deformed without fracture and in particular may be extruded through a die, under very high pressures. This work was published in particular in the publication "Large Plastic Flow and Fracture" published by McGraw-Hill, New York, in 1952, and formed the subject of U.S. Pat. No. 2,558,035.

However, all attempts to utilize the Bridgman effect, for the purposes of extruding a blank of indefinite length, encountered the problem of complexity of equipment, and hitherto have not managed to achieve industrial utilization.

Attention is also directed to my prior U.S. Pat. Nos. 4,041,745; 4,111,023; and 4,163,377 which are incorporated by reference herein. In U.S. Pat. Nos. 4,041,745 and 4,163,777, the present applicant describes a process and an apparatus which open the way to industrial use of hydrostatic extrusion of a blank of indefinite length. In the former of these two U.S. patents as shown in FIG. 6 herein, the blank to be extruded 1 is first shaped so as to form two substantially parallel flat faces, and is then introduced into a channel formed by two coaxial members which move relative to each other, the movable member which is referred to as the "rotor" 3 having a groove of revolution which is greater in depth than in width and which is provided on the surface of the rotor and which comprises two substantially parallel side faces; the other member, referred to as the "stator" 6 forming with the groove a channel which is closed by a projection or lug which is fixed with respect to the fixed member, and carrying at least one die. The blank which is surrounded on all its faces by a viscous liquid is entrained towards the die by the forces developed in the fluid by the rotor, without there being any direct metal-to-metal contact between the blank and the wall surfaces of the rotor, in contrast to the situation in the prior processes such as that disclosed in U.S. Pat. Nos. 3,765,216 and 3,872,703.

In U.S. Pat. No. 4,163,777, which is concerned with an improvement on the first patent, the blank 1 to be extruded is applied against the wall surfaces or the bottom of the groove in the rotor 3, under the action of the viscous fluid, in such a way that the blank is entrained by the rotor without any sliding motion, in the direction of an extrusion chamber from which it is spontaneously extruded through a die 10.

The viscous fluid is passed over the product to be extruded at the extrusion pressure in the vicinity of the die and at lower pressures at one or more points which are between the entry of the product and the die. The distribution of the pressure of the viscous fluid over the product is such that the grip on the two generatrices of the product in contact with the sides of the trapezoidal groove is sufficient to cause the product to be entrained by metal-metal contact, without sliding relative to the rotor.

In this prior apparatus, the die 10 is also disposed outside of the groove, which makes it possible for the die to be made more accessible and for it to be of larger dimensions. From leaving the groove until it reaches the die, the product passes through a chamber provided in the stator 6, in which there prevails the extrusion pressure, the chamber being referred to as an isostatic chamber.

Although these processes and the apparatus for carrying out the processes are entirely satisfactory in operation, a certain number of disadvantages have been found, in particular as regards the pumping power for the viscous liquid. Indeed, the working pressure may reach a value of 1600 MPa and the average leakage rate of the viscous fluid is of the order of 25 to 30 milliliters per second. Taking into account the output, this corresponds to a pumping power which is in the range of 50 to 100 kilowatts. In addition, under this high pressure, the high-output pressure multipliers are subjected to very severe operating conditions and the whole of the apparatus requires relatively substantial and burdensome maintenance.

The subject of the present invention is an improvement in the above-described hydrostatic extrusion apparatus and process.

The improved process concerns the continuous hydrostatic extrusion of a first object, referred to as the blank, of indefinite length, to form a second object which is also indefinite in length but which is different in section, wherein the blank which is surrounded by a substantial amount of a viscous fluid is introduced into a groove which is cut in an entrainment rotor and which faces a stator forming a cover applied to the rotor, which receives directly, by an introduction means, the viscous fluid which is referred to as the drive fluid and in which progressive penetration of a step of the cover into the groove produces a pressure which progressively increases from the point of entry at ambient pressure to the isostatic chamber in which the extrusion pressure prevails, thereby providing at all points sufficient grip for the movement of the rotor to entrain said blank with negligible slip from the upstream end at ambient pressure in a downstream direction to the entrance to the isostatic chamber from which the blank will issue by hydrostatic extrusion through at least one die orifice. The process is characterized in that the drive fluid in the groove is of a viscosity which is higher than that of the fluid in the vicinity of the die, thereby permitting more substantial operating clearances between the rotor and the stator without increasing the leakage rate.

In addition, the fact that the drive fluid which is initially introduced under a low or zero pressure is put under the high pressure required due to the effect of the rotary movement of the rotor makes it possible to omit the expensive and relatively delicate pressure multiplying means.

Each viscous fluid (the drive fluid contained in the groove and the fluid which is in the vicinity of the die) may be selected from solid, liquid, liquefied, pasty or powdery substances which are capable of flow under the temperature and pressure conditions obtaining in the groove and in the isostatic chamber.

Accordingly, the choice of fluid is very wide. Examples of substances which are suitable for carrying out the invention include fatty acid salts (such as oleates, sebacates, palmitates and stearates) and in particular calcium stearate, organic or inorganic powders, for example powders in the form of granules of polyvinylchloride, polyolefins, polytetrafluorocarbon, etc.

As regards the fluid in the isostatic chamber, this fluid may be endowed with a viscosity which is lower than that of the drive fluid in the groove, in several ways, either by heating the isostatic chamber, or by cooling the groove, or by introducing into the isostatic chamber a fluid which, by its very nature, is of lower viscosity than the drive fluid in the groove. The fluid may be a liquid such as a liquid hydrocarbon or a gas which is liquefied under the pressure obtaining in the isostatic chamber, for example butane, propane or carbon dioxide.

Moreover, as working of the process is linked with the viscosity of the fluids used and as the viscosity is itself dependent on temperature, at a given pressure, it is important that the temperature of the fluid or fluids, both in the groove and in the isostatic chamber, can be maintained at a suitable value, whether the fluid is heated to reduce its viscosity or whether it is cooled in order to remove the heat given off by the extrusion process and to increase the viscosity of the fluid or fluids.

Various supplementary arrangements facilitate working of the process: the drive fluid is introduced into a groove through at least one orifice provided in the stator, by any means well known in the art; any excess of drive fluid can be discharged through at least one of the orifices formed in the stator, the drive fluid which escapes from the apparatus by way of the different leakage areas which are essential for operation thereof may be recovered and reintroduced into the high pressure-generator circuit; by virtue of providing a stator comprising two identical members, it is possible for two blanks to be extruded simultaneously; by virtue of providing a rotor which comprises at least two grooves which are capped by a cover in the form of at least two members, each acting as a stator, it is possible for at least two blanks to be extruded simultaneously; and the blank may comprise a plurality of separate elements which are jointly introduced into the groove in the rotor and which are pressed firmly together when they pass through the extrusion die.

The improved apparatus which also forms a subject of the invention and which permits continuous hydrostatic extrusion of a first object, referred to as a blank, of indefinite length, to form a second object which is also indefinite in length but which is different in section, comprises two cooperating coaxial members, one of which is a movable member, referred to as a rotor 3, which, on its surface, carries a groove of revolution 5 which receives the blank 1 to be extruded, the other member being fixed, referred to as the stator 6, and forming over a first sector of the groove which contains the blank and the drive fluid, a cover which is substantially sealing with respect to said fluid, the stator also comprising, in a second sector of the groove which is downstream of the first sector, a projection portion referred to as a lug, which completely closes the section of the groove and which is precisely adapted thereto so as to make the groove sufficiently sealing with respect to the drive fluid, the stator comprising a means for supplying the groove with drive fluid, and an orifice which is disposed opposite the first sector of the groove, in the vicinity of the second sector, and which opens by way of an elongate duct passing through the stator into an isostatic chamber which is in communication towards the exterior through at least one die orifice, the drive fluid supply means producing in the first sector of the groove a pressure gradient from the point of entry at ambient pressure to the entrance of the duct which opens into the isostatic chamber in which the extrusion pressure obtains. The apparatus is further characterized in that it comprises means for regulating the temperature of each fluid.

It is also characterized in that the isostatic chamber is provided with a closable orifice which can be connected to a means for injecting under pressure a fluid which is lower in viscosity than the drive fluid.

By way of simplification, the term "fluid" is used herein to indicate any liquid, liquefied, pasty or powder or even solid substance which is capable of flow under the temperature and pressure conditions obtaining in the apparatus.

The drawings and the following examples will provide a better appreciation of working of the invention.

Figure 1:
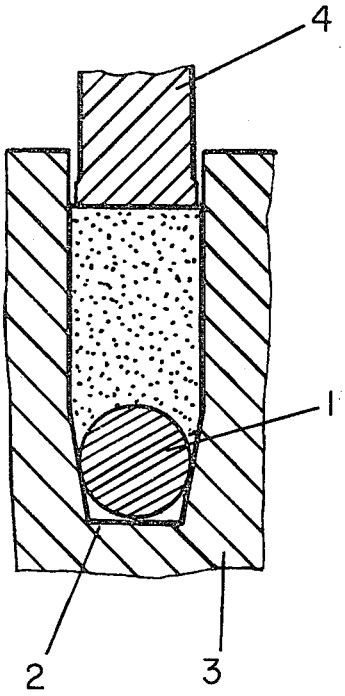
FIGS. 1 and 2 show in cross-section two forms for configurations of the groove in which the blank is entrained.

The blank 1 is disposed in the groove 2 which is of trapezoidal section, formed in the rotor 3. In this case, the blank bears against the sides of the groove but it is entrained without slipping, that is to say, without metal-to-metal friction. The fluid pressure is generated by the spiral-shaped step 4 of the stator, as in U.S. Pat. No. 4,047,745. However, it is also possible to use a groove 5 which has parallel faces (see FIG. 2) in which the blank is entirely surrounded by the drive fluid without contact between the blank and the wall surfaces of the groove.

The stator 6 may include one or more orifices 7 which locally connect the groove in the rotor to a radial conduit 8. In this way, it is possible to adjust the pressure in the corresponding region of the groove by injecting a make-up amount of drive fluid by way of the orifice or orifices 7, or, in contrast, by permitting an excess of drive fluid to escape.

It was discovered that it was possible for the drive fluid no longer necessarily to be a "fluid" in the conventional sense of the word, but any liquid, liquefied, pasty, powdery or even solid substance which has a flow capability under the temperature and pressure conditions existing in the groove and in the extrusion chamber. In particular, it was found that a certain number of powders and in particular salts of fatty acids, under the pressures used, of the order of several thousand bars, had a flow capability which made it possible for them to be used both as an agent for transmitting the hydrostatic pressure and as an agent for driving the blank to be extruded, but, by virtue of their very high "viscosity," insofar as it is possible to talk of viscosity in the case of a substance which is not really fluid, the leakage rate at the different operating clearances of the apparatus is extremely low. As the power of the pumping unit is equal (apart from output) to the product of the leakage rate by the pressure, this means that the power required is considerably reduced relative to that which is required in the case of a conventional viscous fluid such as natural or synthetic oils.

Likewise, powders or granules of polyvinylchloride, polyolefins (polyethylene) and polytetrafluorocarbon are suitable for carrying out the invention.

However, it is sometimes difficult for the same fluid to combine the different characteristics required on the one hand with regard to sealing (low leakage rate) and on the other hand with regard to extrusion (capacity of the fluid to lubricate the die).

It is then possible either to use the same fluid in two different states, or to use two different fluids, for example a stearate powder as the drive fluid and a product of lower viscosity in the isostatic chamber 9 in the vicinity of the die 10, which is injected for example by way of the orifice 11. This fluid may be any liquid hyrocarbon, natural or synthetic oils, or even paraffin oil (also referred to as kerosene).

Figure 7:
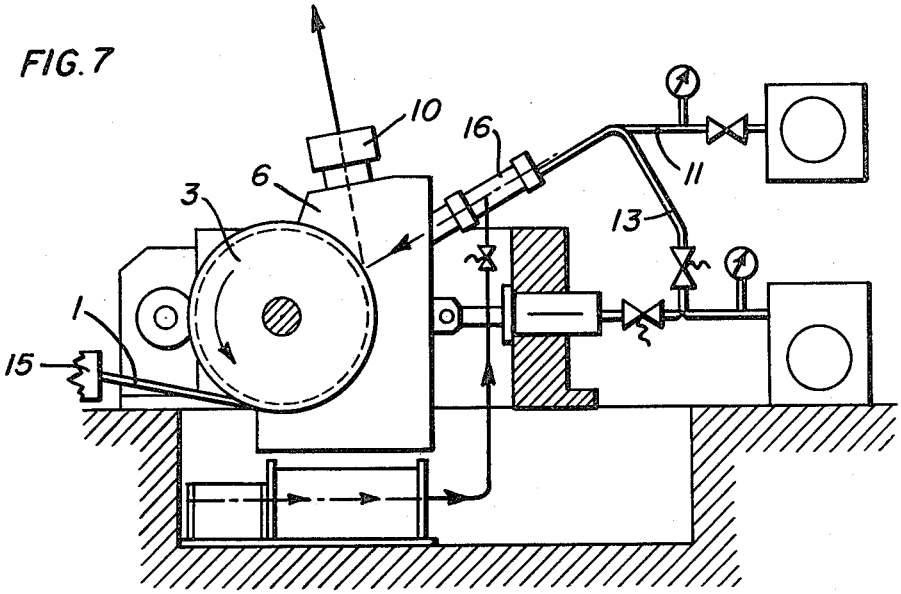
FIG. 7 is a cross section showing the present invention as applied to the apparatus of my prior patent 4,163,377.

As moreover the viscosity of a substance decreases, at a given pressure, when the temperature rises, it may be advantageous for the extrusion apparatus to be provided with known means, such as heating coils 14, for raising the temperature of the fluid to a suitable value, either locally or generally. Thus, it is possible either to heat the isostatic chamber or to cool the groove (and possibly the blank) so that the fluid in the groove is of a viscosity higher than that of the fluid in the isostatic chamber, in accordance with the invention. If the viscous fluid is calcium stearate, it is possible for example to heat the isostatic chamber to a temperature in the vicinity of or above its melting point, which is 180° C. In addition, it is possible to cool the die which generally tends to rise in temperature due to the actual extrusion process. Likewise, in some cases, it may be advantageous for the blank to be preheated in order to increase its capacity for deformation. Note the conventional preheater 15 in FIG. 7.

When a different fluid from the fluid in the groove is injected into the isostatic chamber, in the vicinity of the die, it is necessary for that purpose to use a small pressure multiplying means. However, it should be noted that the multiplying means operates at high pressure and at low flow rate, as at this location there is no leakage other than the thin film of fluid which is entrained by the extruded product and which serves to lubricate the die, such leakage being at a very low rate.

EXAMPLE 1

Figure 2:
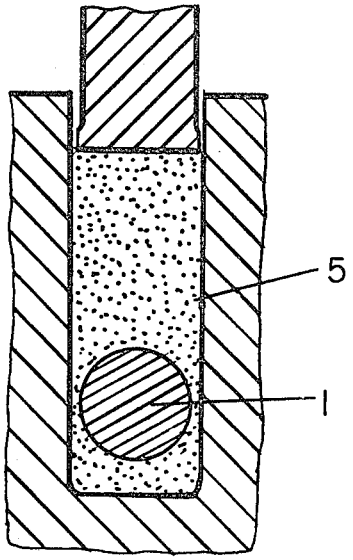
Figure 3:
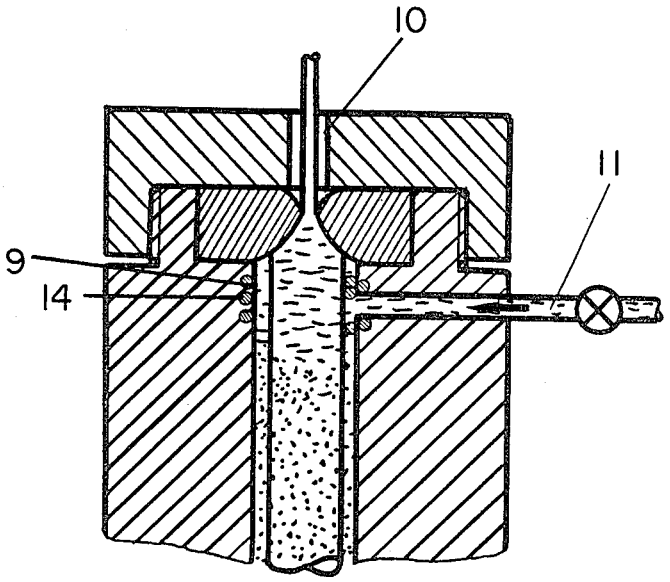
FIG. 3 is a sectional view of the die through which the blank is extruded.
Figure 4:
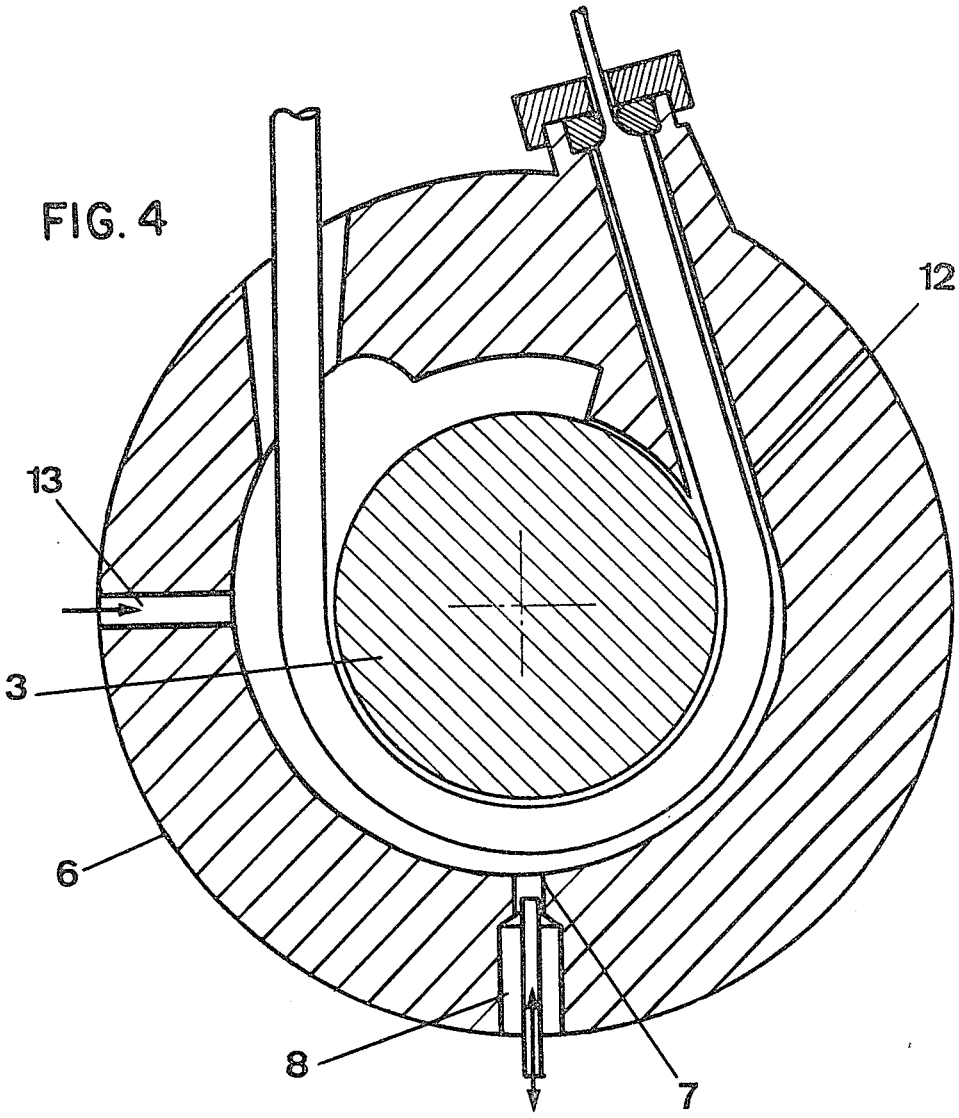
FIG. 4 is a vertical section of the general arrangement of the extrusion apparatus according to the invention.

Using an apparatus as shown in FIGS. 2 and 4, a copper blank which is 10 millimeters in diameter is introduced and entrained at a speed of 0.50 meters per second. The drive fluid is calcium stearate powder. Paraffin oil (kerosene) was also injected at a pressure of 1500 MPa into the isostatic chamber by way of the orifice 11 in the vicinity of the die.

Figure 5:
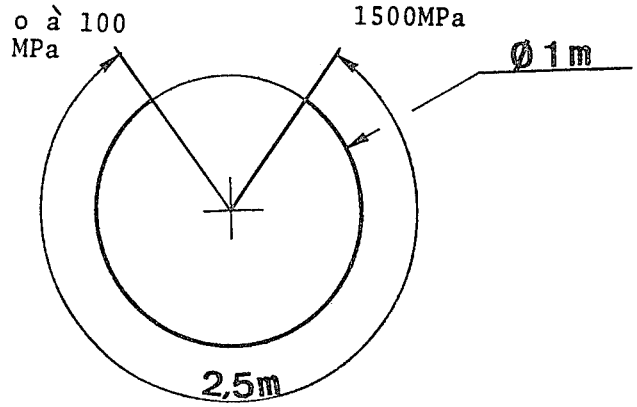
FIG. 5 diagrammatically illustrates the variation in the pressure in the groove.
Figure 6:
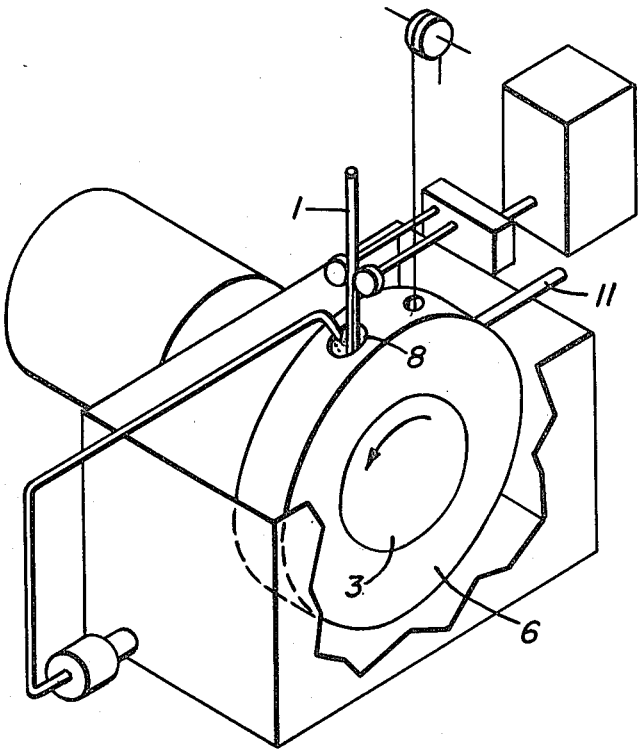
FIG. 6 is a cut away schematic of the entire extrusion apparatus.

The active part of the rotor, which is diagrammatically illustrated in FIG. 5 by the thickened portion of the outside circle, is 2.5 meters in length, and the groove measures $80\times100$ mm in section at the entrance, progressively decreasing in the manner shown in FIG. 5, to a section of $20\times10$ mm at the entrance of the channel 12 which leads to the die whose outlet diameter is 2 mm, this arrangement providing the pressure gradient along the groove to the isostatic chamber.

The drive fluid is injected by way of the orifice 13 at a low or zero pressure which rises to about 1500 MPa at the entrance of the channel 12.

The blank moves forward with the rotor as the gripping force on the blank in the powder is higher than the opposite pushing force which would tend to cause the blank to move rearwardly, applied thereto by the pressure of 1500 MPa. It is estimated that the gripping force of the powder on the wall surfaces of the groove is on average higher than 200 newtons per square centimeter of contact surface area.

The force applied by the powder to cause the blank to move forward is therefore higher than $3.14\times1\times250\times200=15.7\times10^4$ N.

The force which is applied by the extrusion pressure and which tends to resist the forward movement of the blank is: $1.5\times10^9\ \text{Pa}\times0.785\times10^{-4}\text{m}^2=11.8\times10^4$ N.

Comparison between these two results shows that entrainment of the blank by the powder, in the absence of direct metal-to-metal contact between the blank and the walls of the groove and/or the bottom of the groove takes place with an amply sufficient coefficient of safety $$\left(\frac{3.9}{11.8}\times100=33\%\right).$$

The bottom of the groove may then be of any shape whatever, as moreover can be the product to be extruded, provided only that the product can be received in the groove 5.

EXAMPLE 2

Operation was effected under conditions identical to those set forth in Example 1, except that the orifice 11 was closed and the region of the isostatic chamber was heated so as to raise its temperature to 180° C., corresponding to the initial liquefaction point of the calcium stearate.

Extrusion of a 2 mm wire was obtained without difficulty and without any binding or abrasion in the die.

Other types of powders, in particular salts of fatty acids, can be used to form the "viscous fluid" under conditions comparable to those described hereinbefore.

I claim:

1. In a process for the continuous hydrostatic extrusion of an indefinite length blank from a first cross-section to a reduced cross-section comprising the steps of passing said blank lengthwise into the space between a peripherally grooved rotor and a stator having a spiral shaped interior fixed with a relation to and surrounding the rotor, introducing a first viscous driving fluid into said space, increasing the pressure of said fluid between its point of introduction and an isostatic chamber adjacent to a die; the improvement comprising the step of introducing a second fluid, less viscous than said first fluid, into the isostatic chamber adjacent to said die, said viscous driving fluid causing forward movement of said blank toward said die, and said second less viscous fluid acting as a lubricant for the die.

2. A process as defined in claim 1, wherein at least one of the fluids is a powder which has the capacity for flow under the existing temperature and pressure conditions in said space.

3. A process as defined in claim 1, wherein the first driving fluid is a fatty acid salt.

4. A process as defined in claim 3 wherein said first driving fluid is an alkaline or alkaline earth salt of a fatty acid selected from the group comprising oleic, sebacic, stearic and palmitic acid.

5. A process as defined in claim 1, and further including the step of raising the temperature of the fluid in the isostatic chamber.

6. A process as defined in claim 1, and further including the step of regulating the temperature of the fluid in said space.

7. A process as defined in claim 1 and further including the step of recovering fluid leaking past said space and reintroducing it thereinto.

8. A process as defined in claim 1 and further including the step of preheating said blank to increase its capacity for deformation.

* * * * *